US010084221B2

(12) United States Patent
Denis

(10) Patent No.: US 10,084,221 B2
(45) Date of Patent: Sep. 25, 2018

(54) RF WINDOW INCLUDING A PRESTRESSING RING THAT SURROUNDS THE PERIPHERY OF A DIELECTRIC DISC AND APPLIES A RADIAL STRESS TO THE DIELECTRIC DISC

(71) Applicant: THALES, Courbevoie (FR)

(72) Inventor: Philippe Denis, Choisy le Roi (FR)

(73) Assignee: THALES, Courbevoie (FR)

( * ) Notice: Subject to any disclaimer, the term of this patent is extended or adjusted under 35 U.S.C. 154(b) by 13 days.

(21) Appl. No.: 15/338,244

(22) Filed: Oct. 28, 2016

(65) Prior Publication Data

US 2017/0133734 A1 May 11, 2017

(30) Foreign Application Priority Data

Nov. 6, 2015 (FR) ..... 15 02344

(51) Int. Cl.

| | |
|---|---|
| ***H01P 1/08*** | (2006.01) |
| ***H01P 11/00*** | (2006.01) |
| ***H01P 1/04*** | (2006.01) |
| ***H01P 1/30*** | (2006.01) |
| ***H01P 3/12*** | (2006.01) |

(52) U.S. Cl.

CPC ..... *H01P 1/08* (2013.01); *H01P 1/042* (2013.01); *H01P 1/30* (2013.01); *H01P 3/12* (2013.01); *H01P 11/00* (2013.01)

(58) Field of Classification Search

CPC .. H01P 1/08; H01P 1/042; H01P 11/00; H01P 11/001; H01P 11/002

USPC ..... 333/252, 254

See application file for complete search history.

(56) References Cited

U.S. PATENT DOCUMENTS

| | | | | |
|---|---|---|---|---|
| 3,993,969 | A * | 11/1976 | Gross | H01P 1/08 333/248 |
| 4,684,908 | A * | 8/1987 | Kuntzmann et al. | H01P 1/08 333/252 |
| 4,799,036 | A * | 1/1989 | Owens | H01P 1/08 174/28 |
| 7,049,909 | B2 * | 5/2006 | Denis et al. | H01P 1/08 333/252 |
| 2002/0067229 | A1 | 6/2002 | Lubbers | |

FOREIGN PATENT DOCUMENTS

| | | | |
|---|---|---|---|
| CN | 101 789 534 | A | 7/2010 |
| FR | 2 821 487 | A1 | 8/2002 |
| GB | 2 082 844 | A | 3/1982 |
| JP | H10-270902 | A | 10/1998 |

* cited by examiner

*Primary Examiner* — Benny Lee
(74) *Attorney, Agent, or Firm* — Baker & Hostetler LLP

(57) ABSTRACT

An RF frequency window comprises a dielectric disc, a main metal skirt brazed all the way around the periphery of the dielectric disc and a surrounding prestressing ring in contact with the main metal skirt around the periphery of the dielectric disc and applying, in the rest state, over the whole of the periphery of the dielectric disc, a radial compressive stress directed towards the center of the dielectric disc, the prestressing ring comprising a set of at least one cooling channel in the longitudinal direction of the prestressing ring.

15 Claims, 3 Drawing Sheets

RF WINDOW INCLUDING A PRESTRESSING RING THAT SURROUNDS THE PERIPHERY OF A DIELECTRIC DISC AND APPLIES A RADIAL STRESS TO THE DIELECTRIC DISC

CROSS-REFERENCE TO RELATED APPLICATIONS

This application claims priority to foreign French patent application No. FR 1502344, filed on Nov. 6, 2015, the disclosure of which is incorporated by reference in its entirety.

FIELD OF THE INVENTION

The present invention relates to RF frequency windows that are vacuum-tight, these windows in principle being used at the output of an electronic power tube for transmitting RF frequency electromagnetic energy between the inside of the tube (under high-vacuum) and the outside of the tube (under ambient atmospheric pressure, for example).

BACKGROUND

The tube can notably be an amplifier such as a travelling wave tube, having the French acronym TOP (Tube a Ondes Progressives) or the English acronym TWT (Travelling Wave Tube), or a klystron, for example. It can also be an oscillator (magnetron, etc. . . . ). Typically, it is desired to send the energy amplified inside the tube to a waveguide which contains air. The RF frequency window provides free passage, at least within a given frequency band, of the electromagnetic energy into the waveguide while maintaining the tightness to the vacuum inside the tube.

Conventionally, the windows comprise a flat disc made of an insulating dielectric, through which the electromagnetic energy passes. This disc is most often made of alumina or another ceramic having not only very good dielectric properties but also good thermal conductivity and good resistance to high temperatures and steep temperature gradients. In fact, for high power tubes operating with high electric fields, the passage of the energy gives rise to losses in the dielectric and therefore to significant heating. The tubes of concern here can supply powers of several tens of kilowatts. The dielectric disc can typically have dimensions of about ten centimeters in diameter for a thickness of between 1 millimeter and a few millimeters.

In order to obtain the vacuum-tightness, the dielectric disc is brazed around the whole of its periphery onto the inside surface of a cylindrical metal skirt (generally made of copper) which surrounds the dielectric disc.

From the European patent EP 1 364 425 EP (Thales) are known embodiments which make it possible either to carry out a shrink fitting and to apply a prestressing to the assembly or to chill without producing prestressing.

SUMMARY OF THE INVENTION

A purpose of the invention is to make it possible to increase the power at the outlet of an RF frequency window, and therefore notably to improve resistance to thermal stresses, while retaining the advantages of the existing windows.

Therefore, according to one aspect of the invention, there is proposed an RF frequency window comprising a dielectric disc, a main metal skirt brazed all the way around the periphery of the dielectric disc and a surrounding prestressing ring in contact with the main metal skirt around the periphery of the dielectric disc and applying, in the rest state, over the whole of the periphery of the dielectric disc, a radial compressive stress directed towards the center of the dielectric disc, the the surrounding prestressing ring comprising at least one cooling channel in the longitudinal direction of the surrounding prestressing ring.

The solution provided makes it possible to create a cooling circuit around the dielectric disc and a prestressing. This invention makes it possible to improve the mechanical strength extending into the dielectric material. Moreover, by evacuating heat resulting from RF frequency losses in the dielectric material the stresses are thereby minimized.

Another advantage is the fact of having a window which remains cool while being protected from the risk of thermal shock resulting from a difference between the outside temperature and the temperature at the center of the dielectric material.

Finally, by its design, the assembly is produced in a single step such as for example by brazing and because of this manufacturing costs are minimized. Moreover, this assembly is heatable to about 600° C. because the prestressing ring is not adherent and can therefore relax during this thermal cycle.

It is thus possible to produce a compressive stress of between 100 and 1000 bars.

In one embodiment, the prestressing ring comprises an annular zone and is part of a prestressing assembly bearing on an external surface of the main metal skirt around the periphery of the dielectric disc.

It is thus possible to produce an annular zone made from a material different from the rest of the prestressing assembly in order to have better control of the prestressing applied with a suitable material.

According to one embodiment, the prestressing ring is made of stainless steel.

Stainless steel is well suited to cooling circuits through which water flows and has good mechanical strength.

In one embodiment, the prestressing assembly comprises at least a part of a cooling circuit comprising the set of at least one cooling channel.

It is thus possible to connect the window to an external cooling circuit.

According to one embodiment, the prestressing assembly comprises components made of at least a metal that is more rigid than that of the main metal skirt.

In one embodiment, the RF frequency window further comprises an additional metal skirt inside the main metal skirt.

It is thus easy to make a coaxial window.

According to one embodiment, the thickness of the prestressing ring is between 2 and 10 mm.

The thickness of the prestressing ring depends on the diameter of the channels and on the necessary flow rate of the heat transfer fluid.

In one embodiment, the RF frequency window comprises a lubricating substance interposed between the prestressing ring and the main metal skirt, in order to prevent sintering between the prestressing ring and the main metal skirt in the event of a rise in temperature of the prestressing ring.

The lubricating substance is preferably graphite.

According to one embodiment, the dielectric disc is made of ceramic, because ceramic is of limited cost.

In one embodiment, the main metal skirt is made of copper, copper making the metal skirt adaptable to the expansions of the materials and being a good electromagnetic conductor.

According to one embodiment, the prestressing ring comprises a set of a plurality of cooling channels.

For example, each of the cooling channels in the set of the plurality of cooling channels have an identical diameter of between 0.5 and 4 mm, which allows a homogeneous distribution of the prestressing.

The cooling channels have regular spacing.

According to another aspect of the invention, there is also proposed a method of manufacturing an RF frequency window consisting of placing a dielectric disc inside a main metal skirt, with a brazing material, and with a clearance between the periphery of the disc and the main metal skirt, of placing the dielectric disc and the main metal skirt inside a prestressing assembly comprising a prestressing ring pierced with at least one cooling channel and surrounding the main metal skirt over the whole of the periphery of the dielectric disc, a clearance being formed between the prestressing ring and the main metal skirt, of placing a brazing hoop around the prestressing ring with a clearance between the hoop and the prestressing ring, the material of the hoop having a coefficient of expansion lower than a coefficient of expansion of the prestressing ring, of taking the hoop, prestressing ring, main metal skirt and dielectric disc assembly to a temperature ensuring the brazing of the dielectric disc in the main metal skirt, and of allowing the assembly to cool, the cooling ensuring a radial compressive prestressing of the prestressing ring on the main metal skirt and on the dielectric disc.

In one implementation, before placing the prestressing ring around the main metal skirt, a lubricating substance, preferably graphite, is interposed between the prestressing ring and the main metal skirt, preventing sintering between the prestressing ring and the main metal skirt in the event of a rise in temperature of the ring.

BRIEF DESCRIPTION OF THE DRAWINGS

The invention will be better understood on studying a few embodiments described as examples that are in no way limiting and illustrated by the appended drawings in which.

In all of the figures, the elements having identical references are similar. The embodiments described are in no way limiting.

DETAILED DESCRIPTION OF THE INVENTION

In the present description, the features and functions well known to those skilled in the art are not described in detail.

Figure 1:
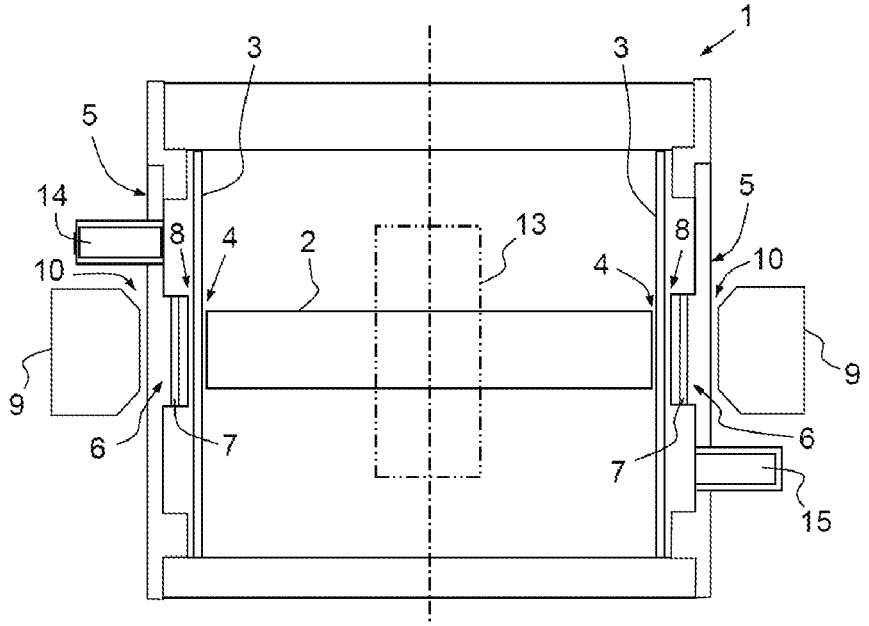
FIGS. 1 to 3 diagrammatically illustrate a method of manufacturing an RF frequency window, according to one aspect of the invention.
Figure 2:
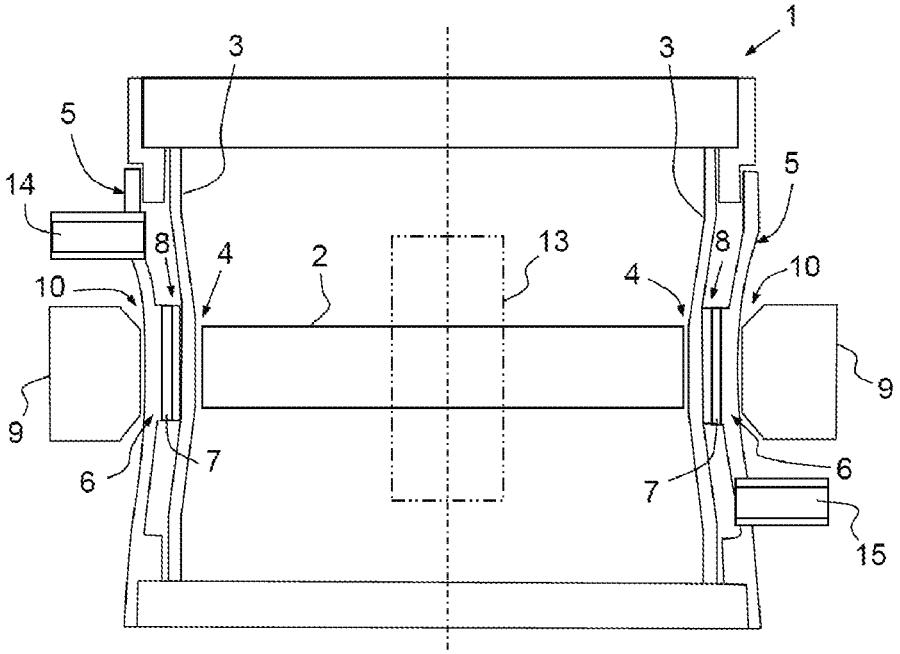
Figure 3:
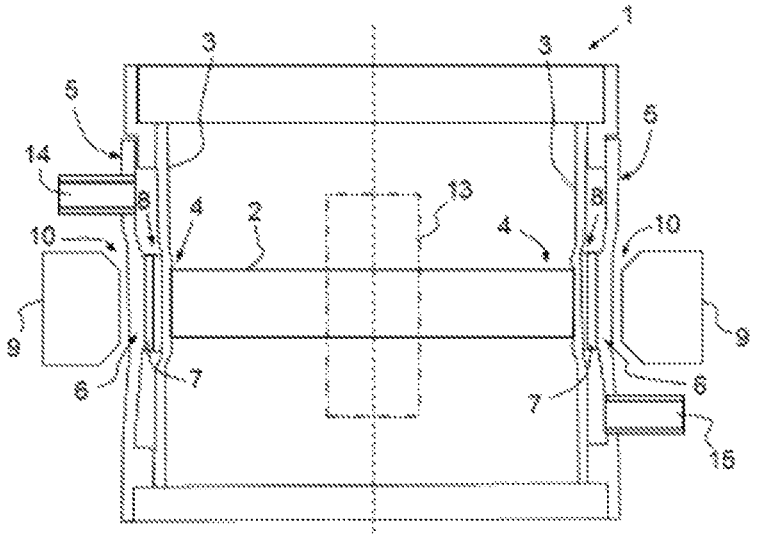

FIGS. 1 to 3 diagrammatically illustrate a method of manufacturing an RF frequency window, according to one aspect of the invention.

In FIG. 1 the parts of an RF frequency window are independent of each other.

The method of manufacturing an RF frequency window 1 consists of placing a dielectric disc 2 inside of a main metal skirt 3, or window skirt, with a brazing material B (as shown schematically in FIG. 4), and with a slight clearance 4 between the periphery of the dielectric disc 2 and the main metal skirt 3, of placing the dielectric disc 2 and the main metal skirt 3 inside a prestressing assembly 5.

The prestressing assembly 5 comprises a prestressing ring 6 pierced with at least one cooling channel 7 and surrounding the main metal skirt 3 over the whole of the periphery of the dielectric disc 2, a clearance 8 being formed between the prestressing ring 6 and the main metal skirt 3. In embodiments, the at least one cooling channel 7 is one of a set of a plurality of cooling channels 7 that pierce the prestressing ring 6. The prestressing assembly 5 comprises components made of at least a metal that is more rigid than that of the main metal skirt 3. In FIGS. 1-4, the prestressing ring 6 is of annular shape. The prestressing ring 6 may be made of stainless steel. A thickness of the prestressing ring may be between 2 and 10 mm. In addition, a lubricating substance L, as shown schematically in FIG. 4, may be interposed between the prestressing ring 6 and the main metal skirt 3, in order to prevent sintering between the prestressing ring 6 and the main metal skirt 3 in the event of a rise in temperature of the prestressing ring 6.

A brazing hoop 9 is placed around the prestressing ring 6 with a clearance 10 between the hoop 9 and the prestressing ring 6, the material of the hoop 9 having a coefficient of expansion lower than that of the prestressing ring 6.

The hoop 9, prestressing ring 6, main metal skirt 3 and dielectric disc 2 assembly is taken to a temperature ensuring the brazing of the dielectric disc 2 in the main metal skirt 3, typically higher than 700° C., and it is allowed to cool, the cooling ensuring a radial compressive prestressing of the prestressing ring 6 on the main metal skirt 3 and on the dielectric disc 2.

The RF frequency window remains open and can receive a flange on each side to ensure the connection for example to a tube outlet on one side and to the client mounting flange or connection on the other side, or even, in the case of an RF frequency transmission window, a client interface can be placed on each side of the cooled prestressing window.

In the figures of the present application there is shown an optional additional metal skirt 13 inside the main metal skirt 3, making it possible for example to produce a coaxial window.

Figure 5:
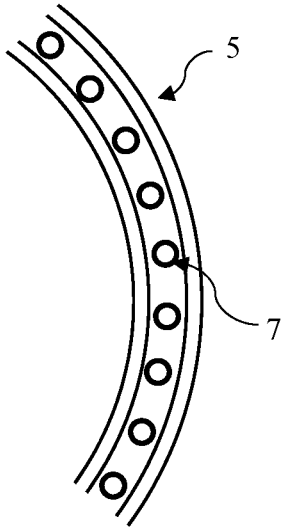
FIG. 5 shows cooling channels, according to one aspect of the invention.

The prestressing assembly 5 comprises at least a part of a cooling circuit, a portion of which is shown in cross-section in FIG. 5, comprising the cooling channels 7. In this case, the prestressing assembly 5 comprises two inlets/outlets 14 and 15 which can be connected to the cooling circuit. The cooling channels 7 may have an identical diameter between 0.5 and 4.0 mm. The cooling channels 7 may have a regular spacing.

The size, shape and spacing of the channels 7 make it possible to adjust on the one hand the flow rate of the heat transfer cooling fluid, such as water or water and glycol and, on the other hand, to adjust the desired prestressing level.

FIG. 1 therefore shows the assembly of the components of the RF frequency window before brazing.

As shown in FIG. 2, the parts of the brazing equipment, not shown, make it possible to ensure the brazing clearances.

The main metal skirt 3, generally made of copper, is assembled in a sealed manner against the dielectric disc 2, generally made of ceramic, and also at each end of the prestressing ring 6 in order to obtain the fluid-tightness of the cooling circuit.

The prestressing is produced during the assembly, for example by brazing, of the assembly at high temperature, typically higher than 700° C.

The hoop 9, made of a material having a coefficient of expansion lower than that of the material of the dielectric disc, makes it possible to progressively deform the cooling circuit and the external diameter of the prestressing ring 6 in order to adjust the assembly parameters.

FIG. 2 therefore shows the assembly of the components of the RF frequency window during the brazing.

As shown in FIG. 3, during the cooling of the assembly cycle, the prestressing ring 6 imparts a compressive stress over the main metal skirt 3 and the dielectric disc 2 dependent on a thickness of the main metal skirt 3, a thickness of the dielectric disc 2, the volume of the cooling circuit (set of channels 7) and the mechanical properties of the material of the prestressing ring 6. The parts compress the assembly while they are returning to ambient temperature.

FIG. 3 therefore shows the assembly of the components of the RF frequency window on completion of the brazing.

Figure 4:
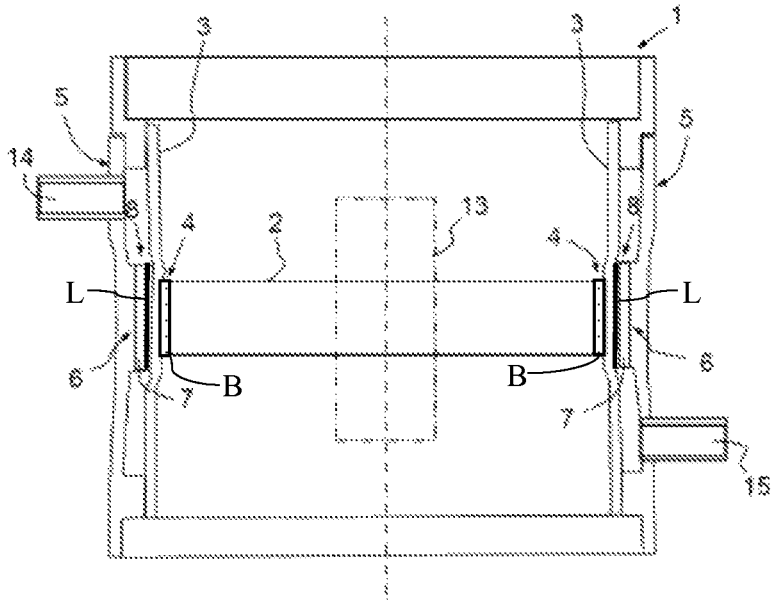
FIG. 4 shows an RF frequency window, according to one aspect of the invention.

FIG. 4 shows the RF frequency window obtained by this method, or, in other words, the assembly of the components of the RF frequency window produced.

The invention claimed is:

1. An RF frequency window comprising a dielectric disc, a main metal skirt brazed all the way around the periphery of the dielectric disc and a surrounding prestressing ring in contact with the main metal skirt around the periphery of the dielectric disc and applying, in the rest state, over the whole of the periphery of the dielectric disc, a radial compressive stress directed towards a center of the dielectric disc, the prestressing ring comprising at least one cooling channel in the longitudinal direction of the prestressing ring.

2. The RF frequency window according to claim 1, wherein the prestressing ring comprises an annular zone and is part of a prestressing assembly bearing on an external surface of the main metal skirt around the periphery of the dielectric disc.

3. The RF frequency window according to claim 2, wherein the prestressing ring is made of stainless steel.

4. The RF frequency window according to claim 2, wherein the prestressing assembly comprises at least a part of a cooling circuit comprising the at least one cooling channel.

5. The RF frequency window according to claim 2, wherein the prestressing assembly comprises components made of at least a metal that is more rigid than that of the main metal skirt.

6. The RF frequency window according to claim 1, comprising an additional metal skirt inside the main metal skirt.

7. The RF frequency window according to claim 1, wherein the prestressing ring has a thickness that is between 2 and 10 mm.

8. The RF frequency window according to claim 1, comprising a lubricating substance interposed between the prestressing ring and the main metal skirt, in order to prevent sintering between the prestressing ring and the main metal skirt in the event of a rise in temperature of the prestressing ring.

9. The RF frequency window according to claim 1, wherein the dielectric disc is made of ceramic.

10. The RF frequency window according to claim 1, wherein the main metal skirt is made of copper.

11. The RF frequency window according to claim 1, wherein the prestressing ring comprises a set of a plurality of cooling channels, and the at least one cooling channel is one cooling channel of the set of the plurality of cooling channels.

12. The RF frequency window according to claim 11, wherein the set of the plurality of cooling channels have regular spacing.

13. The RF frequency window according to claim 11, wherein the set of the plurality of cooling channels have an identical diameter of between 0.5 and 4 mm.

14. A method of manufacturing an RF frequency window consisting of:

placing a dielectric disc inside a main metal skirt, with a brazing material, and with a clearance between the periphery of the dielectric disc and the main metal skirts;

placing the dielectric disc and the main metal skirt inside a prestressing assembly comprising a prestressing ring pierced with at least one cooling channel, and the prestressing assembly surrounding the main metal skirt over the whole of the periphery of the dielectric disc;

forming a clearance between the prestressing ring and the main metal skirt;

placing a brazing hoop around the prestressing ring with a clearance between the hoop and the prestressing ring, the material of the hoop having a coefficient of expansion lower than a coefficient of expansion of the prestressing ring;

taking the hoop, prestressing ring, main metal skirt and dielectric disc assembly to a temperature ensuring the brazing of the dielectric disc in the main metal skirt; and allowing the assembly to cool, the cooling ensuring a radial compressive prestressing of the prestressing ring on the main metal skirt and on the dielectric disc.

15. The method according to claim 14, wherein, before placing the prestressing ring around the main metal skirt, a lubricating substance is interposed between the prestressing ring and the main metal skirt, preventing sintering between the prestressing ring and the main metal skirt in the event of a rise in temperature of the ring.

* * * * *